US011589675B2

(12) United States Patent
Chen

(10) Patent No.: US 11,589,675 B2
(45) Date of Patent: Feb. 28, 2023

(54) ARTICLE STORAGE AND RETRIEVAL APPARATUS

(71) Applicants: BEIJING JINGDONG SHANGKE INFORMATION TECHNOLOGY CO, LTD., Beijing (CN); BEIJING JINGDONG CENTURY TRADING CO., LTD., Beijing (CN)

(72) Inventor: Ying Chen, Beijing (CN)

(73) Assignee: BEIJING JINGDONG QIANSHI TECHNOLOGY CO., LTD., Beijing (CN)

( * ) Notice: Subject to any disclaimer, the term of this patent is extended or adjusted under 35 U.S.C. 154(b) by 129 days.

(21) Appl. No.: 17/269,393

(22) PCT Filed: Jul. 31, 2019

(86) PCT No.: PCT/CN2019/098482
§ 371 (c)(1),
(2) Date: Feb. 18, 2021

(87) PCT Pub. No.: WO2020/042857
PCT Pub. Date: Mar. 5, 2020

(65) Prior Publication Data

US 2021/0386196 A1 Dec. 16, 2021

(30) Foreign Application Priority Data

Aug. 28, 2018 (CN) ..... 201810989350.3

(51) Int. Cl.
*A47B 43/04* (2006.01)

(52) U.S. Cl.
CPC ..... *A47B 43/04* (2013.01)

(58) Field of Classification Search
CPC .... A47B 43/04; A47G 29/141; A47G 29/124; A47G 29/1214; A47G 29/20;
(Continued)

(56) References Cited

U.S. PATENT DOCUMENTS 1,066,297 A 7/1913 Meckert
7,976,113 B2 * 7/2011 Gwak ..... E05B 65/0042 312/405.1
(Continued)

FOREIGN PATENT DOCUMENTS

CN 107518751 A 12/2017
CN 107735001 A 2/2018
(Continued)

OTHER PUBLICATIONS

CN20904344 abstract and Fig.; Wu (Year: 2019).*
(Continued)

*Primary Examiner* — Janet M Wilkens
(74) *Attorney, Agent, or Firm* — Oblon, McClelland, Maier & Neustadt, L.L.P.

(57) ABSTRACT

An article storage and retrieval apparatus includes a main frame; an accommodating assembly, having an article storage state and a folded state, the accommodating assembly including a closed frame rotatably arranged on the main frame and an openable door, and the closed frame being configured to enclose an article storing space between the accommodating assembly and the main frame in the article storing state; a first locking assembly, configured to realize locking between the closed frame and the main frame and allow opening of the article storage and retrieval apparatus after unlocking; and a second locking assembly, configured to realize locking between the closed frame and the openable door and allow the accommodating assembly to switch from the folded state to the article storage state after unlocking.

19 Claims, 5 Drawing Sheets

(58) Field of Classification Search
CPC ..... A47G 29/00; A47G 2029/145; A47G 2029/149; A47G 2029/1226; E05B 47/00; E05B 2047/0067; G06Q 10/0833
USPC ..... 312/1, 292; 232/44, 19, 45, 17, 38, 34; 340/568.1, 569
See application file for complete search history.

(56) References Cited

U.S. PATENT DOCUMENTS

| | | | | |
|---|---|---|---|---|
| 9,861,221 | B2 | 1/2018 | Jiang | |
| 10,076,204 | B1 * | 9/2018 | Sadeghi | A47G 29/141 |
| 10,299,617 | B1 * | 5/2019 | Castellanos | A47G 29/141 |
| 2006/0065705 | A1 * | 3/2006 | Plappert | A47G 29/12 232/19 |
| 2016/0331171 | A1 | 11/2016 | Jiang | |
| 2018/0125278 | A1 | 5/2018 | Jiang | |
| 2020/0352376 | A1 * | 11/2020 | Vernal Silva | A47G 29/1218 |
| 2021/0228013 | A1 * | 7/2021 | Zhang | A47G 29/20 |

FOREIGN PATENT DOCUMENTS

| | | | |
|---|---|---|---|
| CN | 110367795 | * | 10/2019 |
| CN | 209863236 | * | 12/2019 |
| JP | 04327180 | * | 11/1992 |
| JP | H0516993 | * | 1/1993 |
| JP | 7-77911 B2 | | 8/1995 |
| JP | 2019136467 | * | 8/2019 |
| JP | 2020131005 | * | 8/2020 |
| KR | 102276978 | * | 7/2021 |
| WO | WO 2018/032310 A1 | | 2/2018 |

OTHER PUBLICATIONS

WO202057938 abstract and Fig.; Evangedlis et al (Year: 2020).*
KR102276978 English translation (Year: 2021).*
CN2020131005 English translation (Year: 2020).*
JP H0516993 English translation; Hoshino (Year: 1993).*
JP 04327180 English translation; Hoshino et al (Year: 1992).*
CN 209863226 English translation; Chen et al (Year: 2019).*
CN110367795 English translation; Xiao et al (Year: 2019).*
JP 2019136467 English translation; Kinugawa et al (Year: 2019).*
Extended European Search Report dated Mar. 29, 2022 in European Patent Application No. 19855420.6, 5 pages.
International Search Report dated Nov. 18, 2019 in PCT/CN2019/098482 (submitting English translation only), 2 pages.

* cited by examiner

ARTICLE STORAGE AND RETRIEVAL APPARATUS

CROSS-REFERENCE TO RELATED APPLICATION

The present application is a National Stage of International Application No. PCT/CN2019/098482 filed on Jul. 31, 2019, which claims the priority of the Chinese patent application No. 201810989350.3, entitled "ARTICLE STORAGE AND RETRIEVAL APPARATUS" and filed on Aug. 28, 2018, both of which are incorporated herein by reference in their entireties.

FIELD OF THE DISCLOSURE

The present disclosure relates to an article storage and retrieval apparatus.

BACKGROUND OF THE DISCLOSURE

For storage boxes for storing articles, especially the storage boxes placed in open places, such as express boxes, etc., locking is generally required, thus preventing the storage boxes from being used by irrelevant personnel and ensuring the article storage safety. If the storage box adopts special structural design, it is necessary to design rational and humanized lock catches.

In the prior art, for the storage box with multiple layers of openable doors, the common lock catch design is to lock each openable door and the main frame separately to achieve locking, and the locking of each openable door is independent of each other. The locking structure of the storage box is complex, the production cost is high, and the operation is tedious in the use process.

SUMMARY OF THE DISCLOSURE

The embodiment of the present disclosure provides an article storage and retrieval apparatus, including:

a main frame;

an accommodating assembly, having an article storing state and a folded state, the accommodating assembly including a closed frame rotatably arranged on the main frame and an opening and the door closed frame being configured to close an article storing space between the accommodating assembly and the main frame in the article storing state;

a first locking assembly, configured to realize locking between the closed frame and the main frame, and allow opening of article storage and retrieval apparatus after unlocking; and a second locking assembly, configured to realize locking between the closed frame and the openable door and allow the accommodating assembly to switch from the folded state to the article storage state after unlocking.

In some embodiments, the article storage and retrieval apparatus further includes a locking protection part which is arranged on the main frame, and is configured to restrict the second locking assembly from being unlocked when the article storage and retrieval apparatus is in a closed state.

In some embodiments, the second locking assembly is in a locked state during the open or retraction of the closed frame and the openable door relative to the main frame.

In some embodiments, the second locking assembly includes an elastic part configured to deform under the action of an external force to realize locking and unlocking of the second locking assembly.

In some embodiments, the second locking assembly further includes:

a pin shaft, slidably penetrating into a mounting hole in the closed frame;

a platen, fixed on the closed frame, wherein the elastic part comprises a spring and located between the platen and a first end of the pin shaft; and a pin hole, arranged on the openable door;

wherein in a free state, a second end of the pin shaft extends out to enter a pin hole to realize locking; and under the action of an external force, the second end of the pin shaft retracts to be removed from pin hole to realize unlocking.

In some embodiments, a guide portion is arranged at the second end of the pin shaft or at an open end of the pin hole, the guide portion is configured to guide the second end of the pin shaft into the pin hole.

In some embodiments, a mounting direction of the pin shaft is vertical to a rotating plane of the closed frame relative to the openable door.

In some embodiments, the closed frame and the openable door have frame-shaped structures, and at least one second locking assembly is arranged along a circumferential direction of each of the frame-shaped structures.

In some embodiments, the first locking assembly is arranged at an open end, relative to the main frame, of the closed frame and is configured to unlock after identity authentication information of a user is verified successfully.

In some embodiments, the first locking assembly includes:

a lock groove and one of a lock hook, a lock rod and a lock tongue; wherein the lock groove arranged on one of the main frame and the closed frame, and the one of the lock hook, the lock rod and the lock tongue arranged on the other of the main frame and the closed frame and matched with the lock groove; or the first locking assembly comprises: a lock catch arranged on one of the main frame and the closed frame and one of a lock hook and a lock rod arranged on the other of the main frame and the closed frame and matched with the lock catch.

In some embodiments, the second locking assembly includes an elastic part configured to deforms under the action of an external force to realize unlocking of the second locking assembly; and The locking protection part includes a limiting part, wherein the limiting part being arranged in the main frame to prevent the elastic part from changing so as to prevent the second locking assembly from being unlocked when the article storage and retrieval apparatus is in a closed state.

In some embodiments, the locking protection part further includes a guide part arranged opposite to the limiting part, and the closed frame is embedded between the guide part and the limiting part when the first locking assembly is in a locked state.

In some embodiments, guide portions are arranged at free ends of the limiting part and the guide part, and an opening expanding outwards is formed between the two guide portions.

In some embodiments, the article storage and retrieval apparatus further include a restricted part configured to limit a folding angle of the openable door when the accommodating assembly is in the article storage state.

In some embodiments, the restricted part is arranged between the openable door and the closed frame or the main frame so as to limit retraction of the openable door when the accommodating assembly is in article storage state.

In some embodiments, the article storage and retrieval apparatus further includes a locking protection part, configured to restrict the second locking assembly from being unlocked when the article storage and retrieval apparatus is in a closed state, wherein the locking protection part, as the restricted part, is configured to restrict the second locking assembly from entering a locked state when the accommodating assembly is in the article storage state.

In some embodiments, the closed frame and the openable door have frame-shaped structures, and when the article storage and retrieval apparatus is in an unfolded state, the closed frame configured to be folded in an area formed by the openable door and is matched with an inner side wall of the openable door in a circumferential direction.

In some embodiments, the accommodating assembly further includes:

a flexible covering layer, arranged between the closed frame and the openable door; and a supporting frame, arranged along a circumferential direction of the covering layer, the supporting frame being close to the closed frame and the openable door when the accommodating assembly is in the folded state.

In some embodiments, the openable door includes:

two groups of connecting rods, first ends of the two groups of connecting rods being rotatably connected to two sides of the main frame respectively;

a supporting plate, a first end of the supporting plate being rotatably connected to the main frame and being located at the bottom of the connecting rods when the openable door is unfolded; and a door plate, a left side and a right side of an upper end of the door plate being rotatably connected to second ends of the two groups of connecting rods respectively, and a lower end of the door plate being rotatably connected to a second end of the supporting plate, wherein there are two parallelogram connecting rod mechanisms formed by each group of connecting rods, the supporting plate, the door plate and the main frame on two sides of the door plate, and the supporting plate and the door plate are coplanar when the article storage and retrieval apparatus is in the closed state.

In some embodiments, a notch is formed at least at one end of the door plate close to the supporting plate and one end of the supporting plate close to the door plate, and serves as a force applying part when the openable door is opened or closed.

In some embodiments, the closed frame and the openable door are rotatably connected to one of a bottom end, a left end and a right end of main frame.

In some embodiments, the article storage and retrieval apparatus is an express box.

BRIEF DESCRIPTION OF THE ACCOMPANYING DRAWINGS

The accompanying drawings described herein are used to provide further understanding of the present disclosure and constitute a part of the present application. The schematic embodiments of the present disclosure and the description thereof are used to explain the present disclosure, but do not constitute an inappropriate limitation to the present disclosure. In the accompanying drawings.

DETAILED DESCRIPTION OF THE PREFERRED EMBODIMENTS

Figure 1:
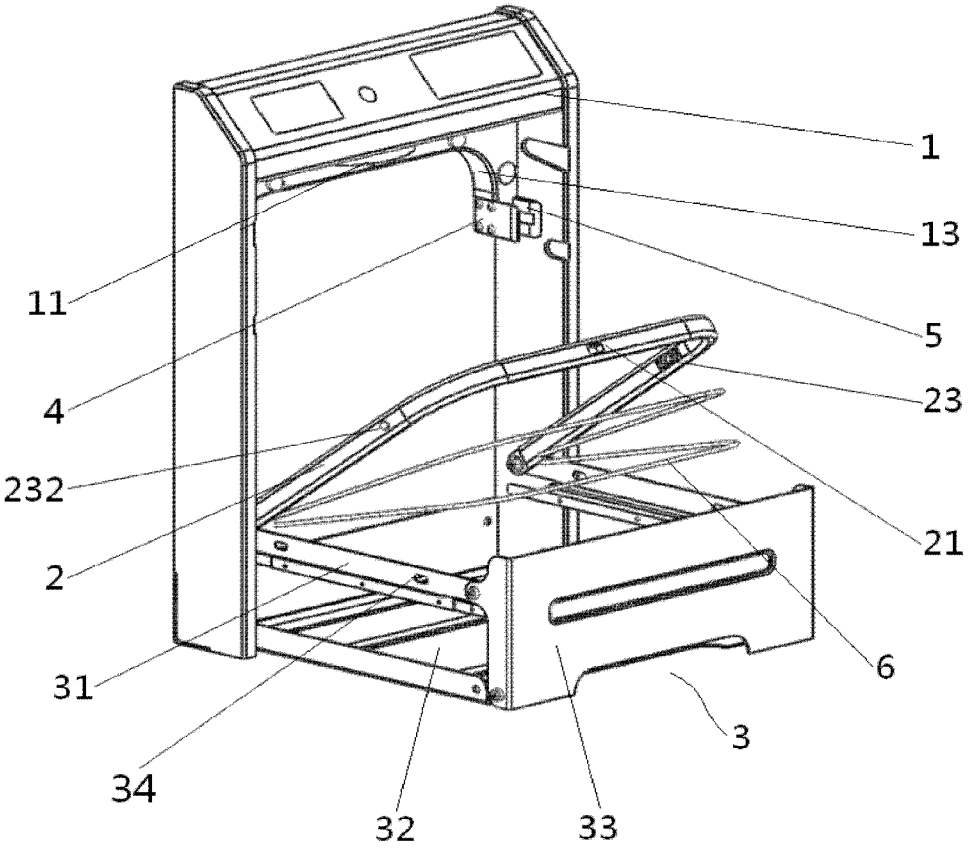
FIG. 1 is a schematic diagram of an internal structure of some embodiments of an article storage and retrieval apparatus according to the present disclosure.

The present disclosure is described hereinafter in detail. In the following paragraphs, different aspects of embodiments are defined in detail. The aspects defined may be combined with one or more of any other aspects unless it is explicitly pointed that they cannot be combined. In particular, any features considered to be preferred or favorable may be combined with one or more of other features considered to be preferred or combination favorable.

The terms "first", "second" and the like appearing in the present disclosure are only used to facilitate description so as to distinguish different components with the same name, but not to represent a sequence or a primary and secondary relationship.

In the description of the present disclosure, it should be understood that an azimuth or position relationship indicated by terms "upper", "lower", "top", "bottom", "front", "rear", "inner" and "outer" and the like is an azimuth or position relationship based on the accompanying draws, which is only for convenient description of the present disclosure, but not indicates or implies that the referred device must have a specific azimuth and perform construction and operation in the specific azimuth; therefore, it cannot be interpreted as a limitation to the protection scope of the present disclosure. In the following description, one side, facing the mounting surface, of the article storage and retrieval apparatus is defined as the rear, and other directions are defined based on this.

As shown in FIG. 1 to FIG. 9, the present disclosure provides an article storage and retrieval apparatus. In some embodiment, the article storage and retrieval apparatus includes a main frame 1, an accommodating assembly, a first locking assembly and a second locking assembly. The main frame 1 is configured to be fixed on a mounting surface. The mounting surface may be a vertical or inclined mounting surface. The vertical mounting surface includes a vertical surface at 90° with a horizontal surface, and a mounting surface with a preset range of angle deviation from the vertical surface. For example, the article storage and retrieval apparatus may be fixed at a position convenient for a specific user to take and place articles. For home users, the mounting surface may be arranged near the user's house, corridor or entrance. For company users, the mounting surface may be arranged near the door of the company.

The embodiment of the present disclosure provides an article storage and retrieval apparatus, which can simplify a locking structure of the article storage and retrieval apparatus.

Based on the technical solution, in the article storage and retrieval apparatus according to the embodiment of the present disclosure, locking of the closed frame and the main frame is realized by the first locking assembly, and after identity authentication information provided by a user is verified successfully, unlocking is conducted to allow opening of the article storage and retrieval apparatus; and locking of the closed frame and the openable door is realized by the second locking assembly, and after unlocking, the accommodating assembly is allowed to switch from the folded state to the article storage state. The article storage and retrieval apparatus does not need to respectively lock the closed frame and the openable door as well as the closed frame and the frame structure, thus simplifying the locking structure, reducing the production cost and reducing the complexity of operation.

The accommodating assembly is configured to place articles and has an article storage state and a folded state. The accommodating assembly includes a closed frame 2 rotatably arranged on the main frame 1 and an openable door 3. The closed frame 2 is located on an inner side of the openable door 3 and serves as an open end of the accommodating assembly. The closed frame 2 is configured to close an article storage space between the accommodating assembly and the main frame 1 under the article storage state. The openable door 3 may serve as a bottom or other parts of the accommodating assembly.

The first locking assembly is configured to realize locking between the closed frame 2 and the main frame 1 and unlock after identity authentication information provided by a user is verified successfully so as to allow opening of the article storage and retrieval apparatus after unlocking, thus putting or taking out articles. The second locking assembly is configured to realize locking between the closed frame 2 and the openable door 3 and allow the accommodating assembly to switch from the folded state to the article storage state when the second locking assembly is unlocked.

The article storage and retrieval apparatus further includes an identity recognition part which is configured to unlock the first locking assembly after identity verification information provided by a user is verified successfully. The article storage and retrieval apparatus has three states, including: a closed state (FIG. 9), an unfolded state (FIG. 7B) and an article storage state (FIG. 8), for example, the unfolded state is that both the closed frame 2 and the openable door 3 are opened relative to the main frame 1, and the closed frame 2 and the openable door 3 may be vertical to the main frame 1 when being unfolded in place. The use includes the following processes:

The article storage and retrieval apparatus is in a closed state when not in use.

When it is necessary to put articles, the first locking assembly is unlocked after the identity information provided by a deliverer is verified successfully, and the article storage and retrieval apparatus may be opened by unfolding the openable door at this time, so that the article storage and retrieval apparatus is in an unfolded state. The unfolding order of the closed frame 2 and the openable door 3 is not limited. The accommodating assembly is still in a folded state at this time. Then, the second locking assembly is unlocked, the closed frame 2 is pulled away from the openable door 3 to form a space for accommodating articles, and the article storage and retrieval apparatus is in the article storage state. After the articles are put, the closed frame 2 moves to the main frame 1, the first locking assembly is in a locked state to close the open end of the accommodating assembly, and the articles are safely stored at this time.

When it is necessary to take out the articles, the first locking assembly is unlocked after identity information provided by a picker is verified successfully, and the accommodating assembly may be folded by unfolding the closed frame 2. Then the articles are taken out, the closed frame 2 and the openable door 3 are retracted, the first locking assembly and the second locking assembly enter the locked state in the retraction process, but the locking order is not limited. At this time, the article storage and retrieval apparatus recovers to the closed state.

In some embodiments, the second locking assembly is in a locked state when the closed frame 2 and the openable door 3 are opened or retracted relative to main frame 1. When it is necessary to put the articles, the closed frame 2 and the openable door 3 are unfolded as a whole, and the second locking assembly is unlocked after the closed frame 2 and the openable door 3 are unfolded in place, so as to allow the accommodating assembly to switch into the article storage state. After the articles are taken out, the closed frame 2 moves close to the openable door 3 to switch the accommodating assembly into the folded state and lock the second locking portion, and then the closed frame 2 and the openable door 3 are entirely retracted to a closed state.

In some embodiments, a user may simultaneously unfold or retract the closed frame 2 and the openable door 3, thereby simplifying operation process and facilitating use; furthermore, the controllability of the openable door in the unfolding process is high, one-hand unfolding may be realized and the operation difficulty is reduced.

In some embodiments, the article storage and retrieval apparatus according to the present disclosure further includes a locking protection part which is arranged on the main frame 1 and is configured to restrict the second locking assembly from being unlocked when the article storage and retrieval apparatus is in a closed state.

In some embodiments, the locking protection part and the second locking assembly form an interlocking structure. When the article storage and retrieval apparatus is in the closed state, the closed frame 2 is in the locked state relative to the main frame 1, and the openable door 3 is in the locked state relative to the closed frame 2 and is restricted from being unlocked by the locking protection part, so that the article storage and retrieval apparatus is simple to open and close. Moreover, if someone pulls the openable door 3 outwards, the openable door 3 cannot be separated from the closed frame 2, so the article storage and retrieval apparatus cannot be opened randomly and only can be opened after identify is verified, thereby avoiding improper use such as human misoperation.

Optionally, the main frame 1, the closed frame 2 and the openable door 3 have rectangular structures. The closed frame 2 and the openable door 3 are rotatably connected to one of a bottom end, a left end and a right end of the main frame 1, for example, connected in a hinged manner. As shown in FIG. 1, the closed frame 2 and the openable door 3 are hinged to a lower end of the main frame 1, the closed frame 2 and the openable door 3 may be unfolded downwards to expose the open end of the accommodating assembly, and the closed frame 2 is pulled upwards to be locked together with the main frame 1, so that the accommodating assembly is in the article storage state. The following embodiments are all described by taking the bottom end of the main frame 1 as an example.

In some embodiments, the first locking assembly is arranged at an open end, relative to the main frame 1, of the closed frame 2 and is configured to unlock after identity authentication information provided by a user is verified successfully. The open end is a position where the closed frame 2 and the main frame 1 are firstly separated. As shown in FIG. 1, the closed frame 2 and the openable door 3 are rotatably connected to the bottom end of the main frame 1, and the first locking assembly is arranged at top ends of the closed frame 2 and the main frame 1. The embodiment can make the locking between the closed frame 2 and the main frame 1 firmer.

Figure 4:
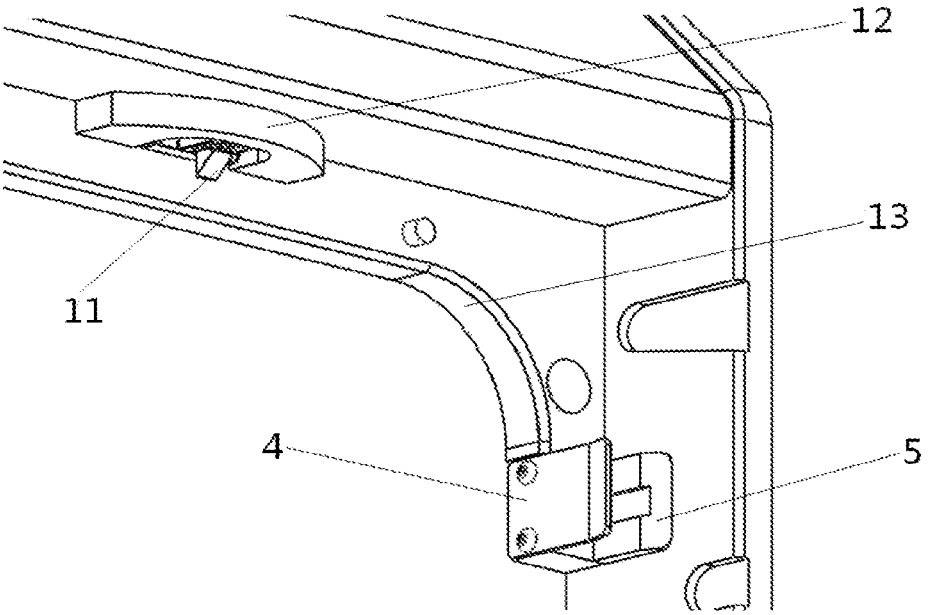
FIG. 4 is a local schematic diagram of a locking protection part in an article storage and retrieval apparatus according to the present disclosure.
Figure 5:
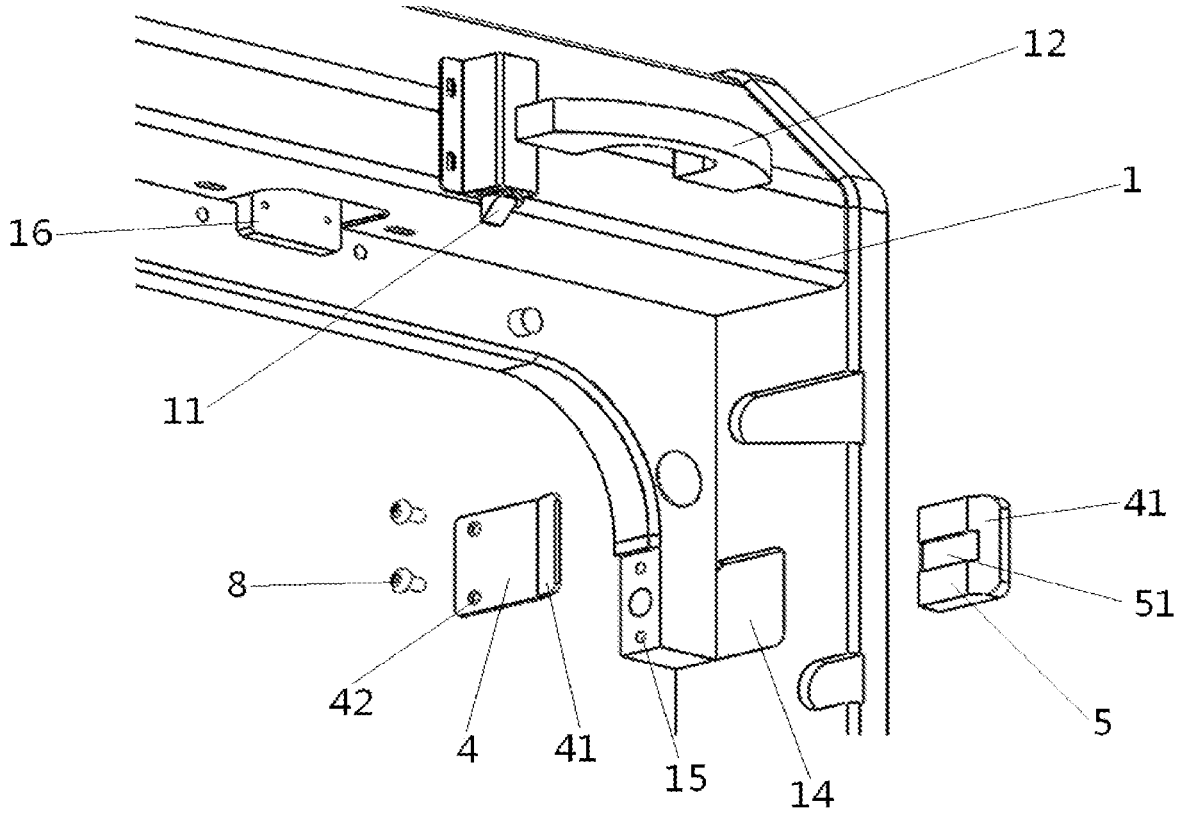
FIG. 5 is a schematic decomposition diagram of a locking protection part in an article storage and retrieval apparatus according to the present disclosure.
Figure 6:
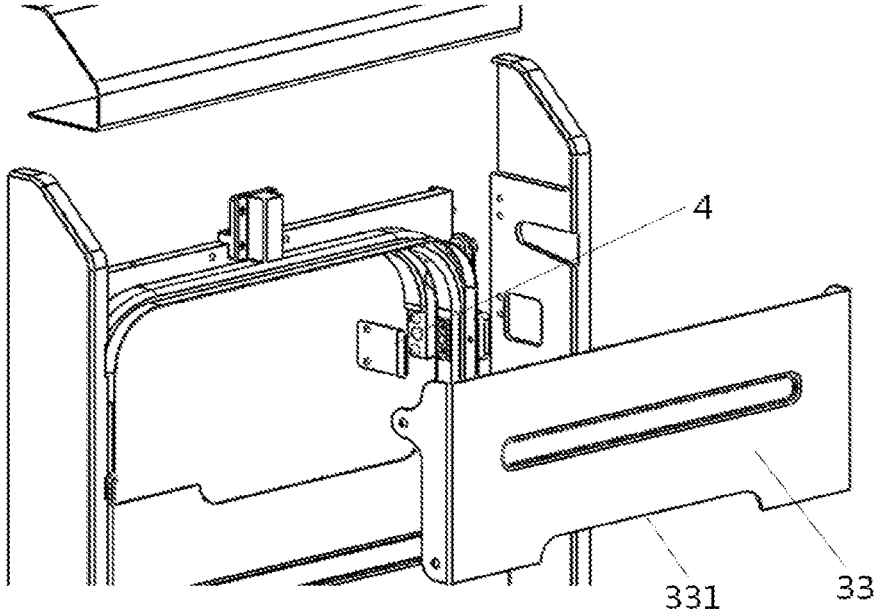
FIG. 6 is a schematic diagram of an internal structure of an article storage and retrieval apparatus according to the present disclosure in a closed state.

Referring to FIG. 1, FIG. 4 and FIG. 5, the first locking assembly includes: a lock groove 21 and one of a lock hook, a lock rod and a lock tongue; wherein the lock groove 21 arranged on one of the main frame 1 and the closed frame 2, and the one of the lock hook, the lock rod and the lock tongue arranged on the other of the main frame 1 and the closed frame 2 and matched with the lock groove 21. Or the first locking assembly includes: a lock catch arranged on one of the main frame 1 and the closed frame 2 and one of a lock hook and a lock rod arranged on the other of the main frame 1 and the closed frame 2 and matched with the lock catch. An electromagnetic lock 11 may be adopted so as to directly unlock the first locking assembly after identity authentication information provided by the user is verified successfully.

As shown in FIG. 1, the first locking assembly includes an electromagnetic lock 11 formed on the main frame 1 and a lock hook 21 formed in the main frame 1. For example, a mounting plate 16 may be arranged at a middle position along a left-right direction in a top wall of the main frame 1, and the electromagnetic lock 11 is fixed on the mounting plate 16, so that the electromagnetic lock 11 may move vertically. The closed frame 2 has a frame-shaped structure, and the locking groove 21 is formed at a middle position of the top of the frame-shaped structure. The electromagnetic lock 11 is inserted into the lock groove 21 under the locked state, and the electromagnetic lock 11 is separated from the lock groove 21 under the unlocked state. To prevent the electromagnetic lock 11 from being damaged, a protective cover 12 is arranged outside the electromagnetic lock 11.

Figure 2:
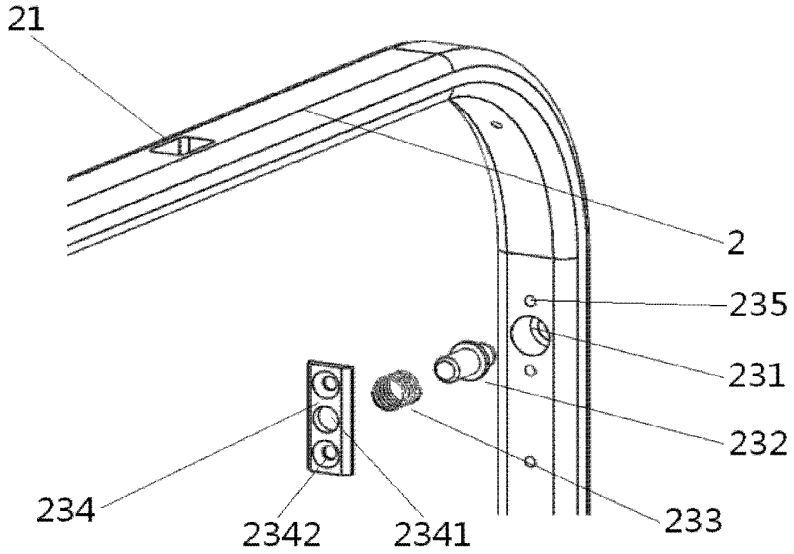
FIG. 2 is a schematic decomposition diagram of some embodiments of a second locking assembly in an article storage and retrieval apparatus according to the present disclosure.

Referring to FIG. 2, the second locking assembly includes an elastic part 233 which is configured to deform under the action of an external force, so that the second locking assembly is locked and unlocked. After the closed frame 2 and the openable door 3 as a whole are in the unfolded state, if an external force away from the openable door 3 is applied to the closed frame 2, the second locking assembly can be unlocked; and if an external force towards the openable door 3 is applied to the closed frame 2, the second locking assembly can be locked.

In some embodiments, in the closed state and the article storage state of the article storage and retrieval apparatus, locking can be realized only by one electromagnetic lock, and the article storage and retrieval apparatus can be opened only by unlocking one electromagnetic lock without locking two electromagnetic locks as in the prior art, so that operation process may be simplified, control difficulty may be reduced, and the structure of the second locking assembly can be simplified, thereby reducing cost. In addition, locking and unlocking of the second locking assembly can be realized by directly pushing and pulling the closed frame 2, so that the operation can be further simplified and the article storage and retrieval apparatus is more convenient to use and simpler to control.

As shown in FIG. 2, the second locking assembly adopts a structure in which a spring lock 23 is matched with a pin hole 34, and the pin hole 34 is formed in the openable door 3. This structure is sensitive in action and may be locked and unlocked reliably through a simple structure.

Figure 3A:
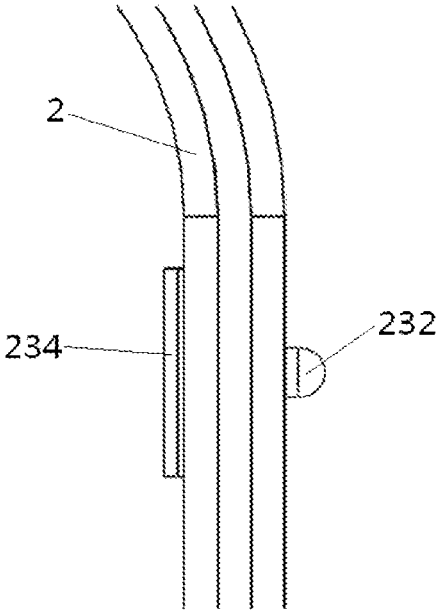
FIG. 3A and FIG. 3B are respectively schematic diagrams of a pin shaft in a second locking assembly in extension and retraction states.

Specifically, the spring lock 23 in the second locking assembly further includes: a pin shaft 232 and a platen 234, wherein the pin shaft 232 slidably penetrates into a mounting hole 231 in the closed frame 2; the platen 234 is fixed on the closed frame 2; and an elastic part 233 is a spring and is located between the platen 234 and the ping shaft 232. As shown in FIG. 3A, in a free state, a second end of the pin shaft 232 extends out to enter the pin hole 34 to realize locking; and as shown in FIG. 3B, under the action of an external force, the second end of the pin shaft 232 retracts to be removed from the pin hole 34 to realize unlocking.

As shown in FIG. 2, the closed frame 2 has a frame-shaped structure, a hollow area is surrounded by the frame-shaped structure, the second locking assembly is arranged on a side rod of the frame-shaped structure, and the mounting hole 231 is formed in the side rod of the frame-shaped structure and is a stepped hole. The pin shaft 232 is provided with an annular thrust boss in a middle area along a length direction, the spring sleeves the first end of the pin shaft 232, the platen 234 is fixed on a side wall, close to the hollow area, of the side rod, and the spring is limited between the thrust boss and the platen 234. The platen 234 is provided with a guide hole 2341, the first end of the pin shaft 232 extends into the guide hole 2341, and the second end of the pin shaft 232 may extend into or be removed from the pin hole 34. To fix the platen 234, third holes 235 are formed at an upper end and a lower end the mounting hole 231 on the side rod of the closed rod 2 respectively, second holes 2342 are formed on an upper side and a lower side of the guide hole 2341 on the platen 234, and a fastener passes through the second holes 2342 and the third holes 235 to fix the platen 234.

In some embodiments, a guide portion is arranged at the second end of the pin shaft 232 or at the open end of the pin hole 34, so that the second end of the pin shaft 232 enters the pin hole 34. For example, the guide portion may design a spherical surface at the second end of the pin shaft 232, or set a chamfer or a round corner at the second end of the pin shaft 232 along a circumferential direction.

Figure 3B:
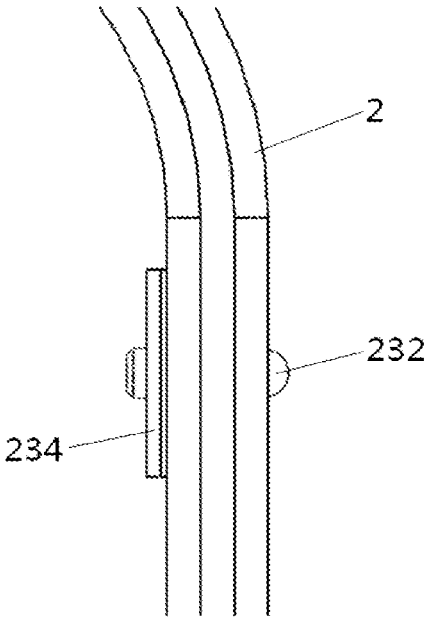

Specifically, as shown in FIG. 3B, when it is necessary to unlock the second locking assembly, an external force away from the openable door 3 is applied to the closed frame 2, the second end of the pin shaft 232 is retracted inward by the external force, and the thrust boss moves inward to force the spring to compress. As shown in FIG. 3A, after the closed frame 2 and the openable door 3 are unlocked, the pin shaft 232 extends outward under the reset action of the spring until the thrust boss abuts against the stepped hole, and the second end of the pin shaft 232 extends out of an outer surface of the side rod.

Based on this, as shown in FIG. 3B, when it is necessary to lock the second locking assembly, an external force close to the openable door 3 is applied to the closed frame 2, the second end of the pin shaft 232 is retracted inward by the external force, and the thrust boss moves inward to force the spring to compress. As shown in FIG. 3A, when the pin hole 34 is aligned with the pin shaft 232, the spring makes the pin shaft 232 to extend out under the reset action of the spring until the thrust boss abuts against the stepped hole, and at this time, the second end of the pin shaft 232 extends into the pin hole 34 to realize locking.

Optionally, an axis of the pin shaft 232 is vertical to a rotating plane of the closed frame 2 relative to the openable door 3. In this way, an external force may be applied directly vertical to the closed frame 2, so that locking and unlocking of the second locking assembly can be realized, and all the applied external force acts on the second locking assembly, thus saving efforts in operation.

Figure 7A:
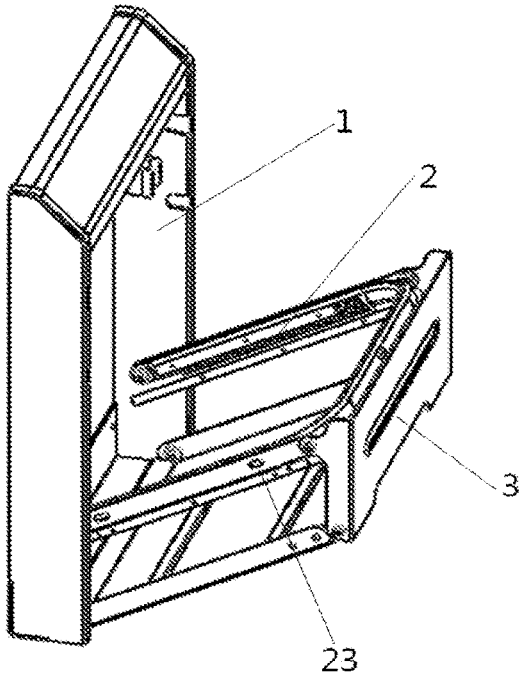
FIG. 7A and FIG. 7B are respectively state schematic diagrams of an article storage and retrieval apparatus according to the present disclosure in the unfolding process of an openable door and after the openable door is unfolded in place.
Figure 7B:
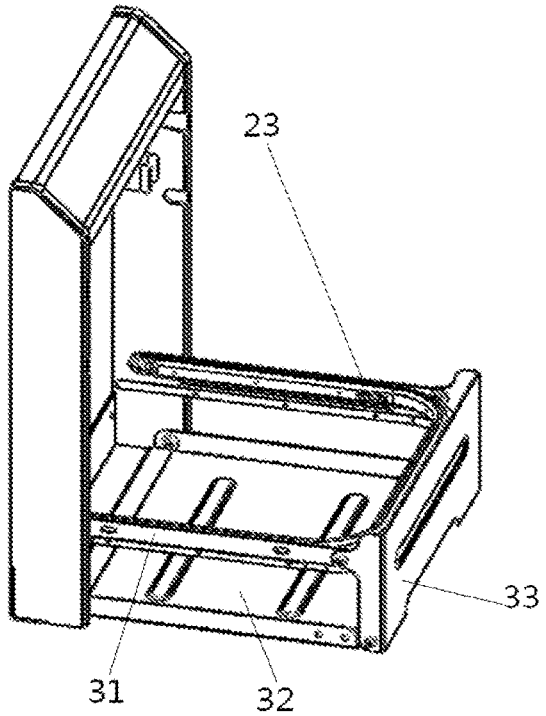

In some embodiments, the closed frame 2 and the openable door 3 have frame-shaped structures, and at least one second locking assembly is arranged along a circumferential direction of each of the frame-shaped structures. As shown in FIG. 7A and FIG. 7B, one second locking assembly may be arranged on each of a left side rod and a right side rod of the openable door, so that locking between the closed frame 2 and the openable door 3 is more reliable and firmer; moreover, when the external force is applied for unlocking, forces to the left side and the right side of the closed frame 2 may be more balanced, thus preventing the influence on the matching precision and the service life of each part caused by a laterodeviation phenomenon. For example, the second locking assembly may be arranged close to the open ends of the closed frame 2 and the openable door 3, thereby enhancing the fixing firmness.

In some embodiments, referring to FIG. 1 and FIG. 4, the second locking assembly includes an elastic part 233, and the elastic part 233 can be deformed under the action of the external force, so that the second locking assembly is unlocked. The locking protection part mentioned above includes a limiting part 4, wherein the limiting part is 4 arranged in the main frame 1 and is configured to prevent the elastic part 233 from changing so as to prevent the second locking assembly from being unlocked when the article storage and retrieval apparatus is in the closed state.

In some embodiments, the limiting part 4 and the second locking assembly form an interlocking structure. When the article storage and retrieval apparatus is in the closed state, the closed frame 2 is in the locked state relative to the main frame 1; meanwhile, the openable door 3 is also in the locked state relative to the closed frame 2, and at this time, the second locking assembly cannot be unlocked under the blocking of the limiting part 4. If someone pulls the openable door 3 outwards, the openable door 3 cannot be separated from the closed frame 2; therefore, the article storage and retrieval apparatus cannot be opened randomly and only can be opened after identity is verified, thus preventing improper use caused by human misoperation.

In some embodiments, the locking protection part further includes a guide part 5, the guide part 5 is arranged opposite to the limiting part 4, and the guide part 5 is configured to guide the closed frame 2 to enter between the guide part 5 and the limiting part 4 in the process of locking the closed frame 2 and the main frame 1. When the first locking assembly is in the locked state, the closed frame 2 is embedded between the guide part 5 and the limiting part 4.

According to the embodiment, the closed frame 2 and the main frame 1 can be locked successfully, so that the limiting part 4 can reliably limit unlocking of the second locking assembly, thus preventing the limiting part 4 from failing to function due to position deviation.

In some embodiments, guide portions 41 are arranged at free ends of the limiting part 4 and the guide part 5, and an opening expanding outwards is formed between the two guide portions 41. In this way, even if the closed frame 2 swings from side to side in the closing process, the closed frame 2 can successfully enter between the guide part 5 and the limiting part 4. For example, each of the guide portions 41 may be an inclined surface arranged opposite to the limiting part 4 or the guide part 5, and the free end of the limiting part 4 or the guide part 5 may be deflected outward.

In a specific embodiment, referring to FIG. 1 and FIG. 5, to adapt to a height of the closed frame 2 in the main frame 1 after the closed frame 2 is closed, a boss 13 is arranged in the main frame 1, so that the closed frame 2 is in a vertical state under the limiting action of the boss 13 after being closed. An inner contour shape of the boss 13 may be adapted to a shape of the closed frame 2. The limiting part 4 may adopt a limiting plate and is fixed on an inner side wall of the boss 13 at a position corresponding to the second locking assembly. For example, two first holes 15 are formed in the inner side wall of the boss 13 along a height direction, two fourth holes 42 are formed in the limiting plate correspondingly, and a fastener 8 passes through the fourth holes 42 and the first holes 15 to fix the limiting part 4. A mounting groove 14 is arranged on an inner wall, higher than the boss 13, of the main frame 1 along a thickness direction, the guide part 5 may be fixed in the mounting groove 14 through a fastener, and an avoidance groove 51 may be formed at one side, facing the limiting part 4, of the guide part 5, thus preventing the protrusion of the fastener from affecting normal closing of the closed frame 2.

In some embodiments, the article storage and retrieval apparatus according to the present disclosure further includes a restricted part which is configured to limit a folding angle of the openable door 3 when the accommodating assembly is in the article storage state. When articles are stored in the accommodating assembly and the open end is closed, the restricted part limits the retraction amplitude of the openable door 3 so as to avoid extrusion of the articles caused by that the openable door 3 is forcibly retracted, thus preventing artificial destruction and improper use.

Optionally, the restricted part is arranged between the openable door 3 and the closed frame 2 or the main frame 1 so as to limit retraction of the openable door 3 when the accommodating assembly is in the article storage state. Since the restricted part is not shown in the figure, it will be described with reference to FIG. 1 that the restricted part may be arranged between the openable door 3 and a side wall of the main frame 1 so as to lock when the openable door 3 is completely unfolded, thereby limiting retraction of the openable door 3. Or the restricted part may be arranged between the openable door 3 and a side part of the closed frame 2 to perform position locking on the openable door 3 and the closed frame 2 when the articles are stored in the accommodating assembly and the open end is closed, thus preventing retraction of the openable door 3.

The embodiment can protect the articles stored in the accommodating assembly well, improve the storage safety of the articles and prevent the articles from being extruded regardless of the size of the articles, and may avoid artificial destruction and improper use.

Optionally, the article storage and retrieval apparatus further includes a locking protection part, configured to restrict the second locking assembly from being unlocked when the article storage and retrieval apparatus is in a closed state, wherein the locking protection part, as the restricted part, is configured to restrict the second locking assembly from entering a locked state when the accommodating assembly is in the article storage state.

Specifically, when the articles are stored in the accommodating assembly and the open end is closed, the closed frame 2 is embedded between the limiting part 4 and the guide part 5 and the limiting part 4 blocks retraction of the pin shaft 232. If someone pushes back the openable door 3 at this time, the pin shaft 232 cannot be retracted, so the openable door 3 cannot be closed, and the articles may be prevented from being extruded and damaged by improper use.

According to the embodiment, the locking protection part has two functions of preventing the openable door 3 from being forcibly opened by the external force when the article storage and retrieval apparatus is not in use, and preventing the openable door 3 from being pushed back by the external force to avoid extrusion of the articles when the article storage and retrieval apparatus stores articles. This structure may further simplify the form of the locking structure and reduce the operation difficulty.

In some embodiments, as shown in FIG. 7B, the closed frame 2 and the openable door 3 have frame-shaped structures, each of which may be designed into closed frame-shaped structure, or may be designed into a frame-shaped structure with an open end close to the main frame 1. When the article storage and retrieval apparatus is in an unfolded state, the closed frame 2 can be folded in an area formed by the openable door 3 and is matched with an inner side wall of the openable door 3 in a circumferential direction.

For example, the closed frame 2 is arranged at a position close to the top of the openable door 3 in a thickness direction, so that the external force is applied conveniently to unlock the second locking assembly, and the closed frame 2 is matched to the inner side wall of the openable door 3 in the circumferential direction, thus increasing the size of the open end of the accommodating assembly. Furthermore, a space between the closed frame 2 and the bottom of the openable door 3 can be increased, which is beneficial to setting an accommodating assembly with larger volume.

Figure 8:
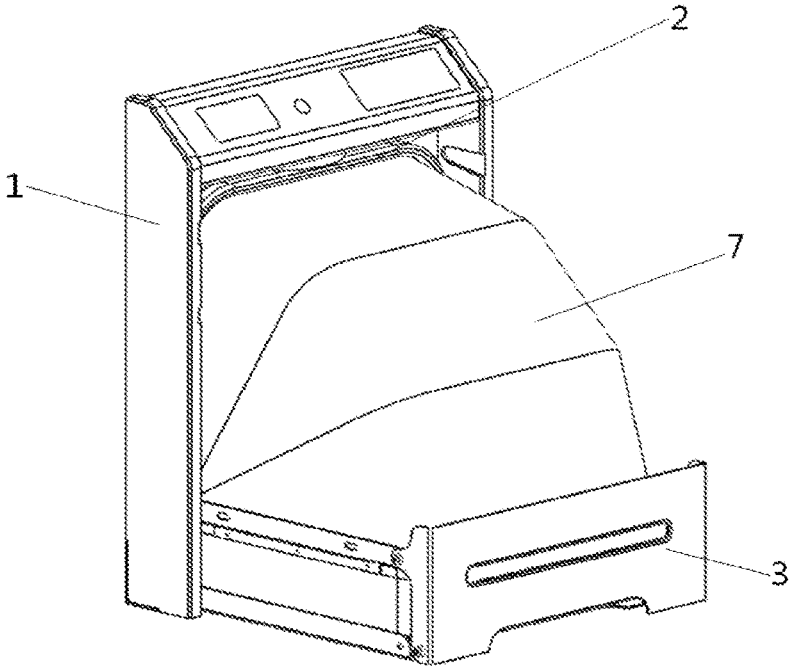
FIG. 8 is a schematic diagram of an article storage and retrieval apparatus according to the present disclosure in an article storage state.

In some embodiments, as shown in FIG. 8, the accommodating assembly further includes a supporting frame 6 and a flexible covering layer 7, for example, made of a cut-resistant material. The covering layer 7 is arranged between the closed frame 2 and the openable door 3. When the accommodating assembly is in the article storage state, the opening door 3 forms bottom support of the accommodating assembly and can reliably support when heavy articles are placed. The supporting frame 6 may be arranged along a circumferential direction of the covering layer. To improve the stability after the covering layer 7 is unfolded, a plurality of supporting frames 6 may be arranged between the closed frame 2 and the openable door 3 at intervals. When the accommodating assembly is folded, the supporting frames 6 are close to each other and close to the closed frame 2 and the openable door 3, and the folded accommodating assembly is located in a box space formed after the openable door 3 is unfolded.

In some embodiments, as shown in FIG. 7A and FIG. 7B, the openable door 3 includes: two groups of connecting rods 31, a supporting plate 32 and a door plate 33. First ends of the two groups of connecting rods 31 are rotatably connected to two sides of the main frame 1, for example, connected to a bottom end area of the main frame 1. In FIG. 7A and FIG. 7B, one connecting rod 31 is arranged on each of two sides. Of course, a plurality of connecting rods 31 may be arranged along a height direction of the main frame 1. A first end of the supporting plate 32 is rotatably connected to the bottom of the main frame 1 and is located at the bottoms of the connecting rods 31 when the openable door 3 is in an unfolded state. A left side and a right side of an upper end of the door plate 33 is rotatably connected to second ends of two groups of connecting rods 31 respectively; a lower end of the door plate 33 is rotatably connected to a second end of the supporting plate 32; and rotating shafts at rotatable connection positions in the openable door 3 are horizontally arranged in a plane parallel to the main frame 1.

There are two parallelogram connecting rod mechanisms formed by each group of connecting rods 31, the supporting plate 32, the door plate 33 and the main frame 1 on two sides of the door plate 33. When the article storage and retrieval apparatus is in the unfolded state, as shown in FIG. 7B, the connecting rod mechanism becomes rectangular and forms a box-shaped structure; when the article storage and retrieval apparatus is in the closed state, the connecting rod structure is gradually retracted, the connecting rods 31 are gradually close to the supporting plate 32; and in the closed state, as shown in FIG. 9, the supporting plate 32 and the door plate 33 are coplanar, so that the occupied space of the article storage and retrieval apparatus in a non-use state is reduced.

As shown in FIG. 7B, reinforcing strips may be arranged on an inner wall or an outer wall of the supporting plate 32 and the door plate 33, so that the strength of the openable door 3 is enhanced and the load-bearing characteristic of the accommodating assembly is improved.

Figure 9:
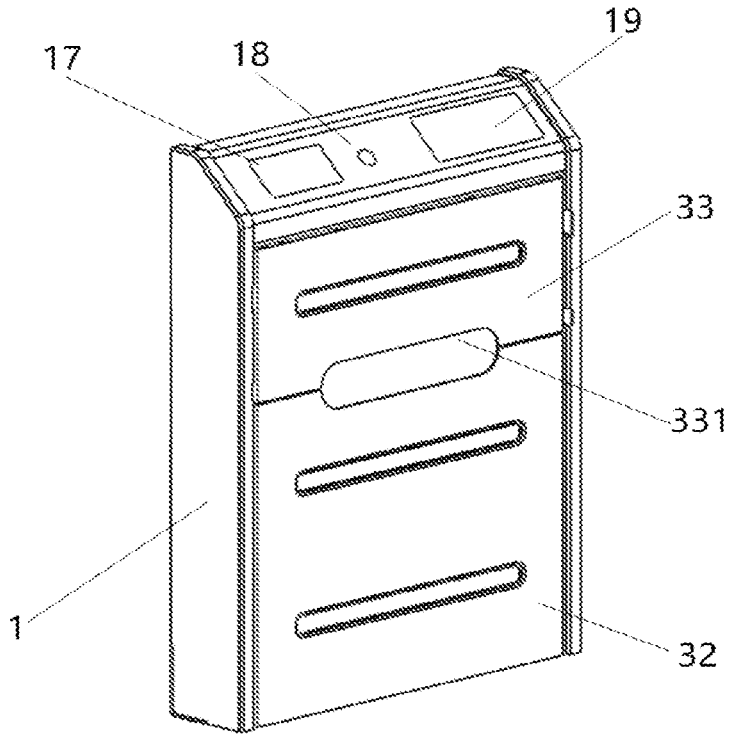
FIG. 9 is a schematic diagram of an article storage and retrieval apparatus according to the present disclosure in a closed state.

As shown in FIG. 9, a notch 331 is formed at least at one end of the door plate 33 close to the supporting plate 32 and one end of the supporting plate 32 close to the door plate 33, and serves as a handle when the openable door 3 is opened or closed to form a wedging block for pulling the openable door 3.

The identity recognition part mentioned in the above embodiment may adopt various structure forms, for example, identity verification may be conducted through code scanning, face recognition, sound recognition, fingerprint recognition, verification code check and the like, and the electronic locking part is unlocked after identity is verified successfully. Or remote control unlocking may be conducted on a mobile terminal APP through a wifi module and/or a Bluetooth module. To realize the identity recognition function, as shown in FIG. 9, a man-machine interaction screen 17 and a camera 18 may be arranged on the main frame 1, the man-machine interaction screen 17 may display information or receive identity recognition of the user, and the camera 18 may provide face recognition. In addition, a solar charging panel 19 may be arranged on the main frame 1.

In one embodiment, the article storage and retrieval apparatus is an express box, correspondingly, the article is an express. The express box may be used by specific users and relevant courier. After identity information input by the deliverer is verified successfully, the closed frame 2 and the openable door 3 are unfolded as a whole, and when the second locking assembly is unlocked, the accommodating assembly may be unfolded in the article storage state, so that the deliverer can put express in the accommodating assembly conveniently; after the express is put, the closed frame 2 and the main frame 1 are locked; after identity information input by a picker is verified successfully, the closed frame 2 and the main frame 1 are unlocked; and after the express is taken out, the accommodating assembly is folded, and the closed frame 2 and the openable door 3 are locked to be retracted as a whole until the closed frame 2 and the main frame 1 are locked, so that the occupied space of the express box in a non-use state is reduced.

Compared with the shared express cabinet, the express box is simple in structure and small in volume, may flexibly adapt to the needs of the user for sending and receiving express and online shopping, and is more convenient for the user to receive and send the express, thereby improving the convenience for the deliverer or the picker to store and take the express. In different usage scenarios, the deliverer and the picker correspond to one role of the courier and the user respectively.

The article storage and retrieval apparatus may be used by the courier for delivery and by the user for taking out the express, so that when the delivery time of the courier and the receiving time of the user cannot be matched with each other, the delivery time may be saved, the delivery efficiency may be improved, and the safety of temporary express storage is improved; moreover, the article storage and retrieval apparatus may be used by the user for sending articles or returning and changing goods and the user does not need to wait for the courier to pick up goods at home, thus improving the experience of the user when sending express and returning or changing goods. The structure not only can meet the express storing and taking requirement when in use, but also can reduce the occupied space when not in use in a normal state, and has a simple structure.

By taking the case where the courier needs to deliver the express and the user takes out the express as an example, the use method of the article storage and retrieval apparatus with the structure, as an express box, is described below with reference to FIG. 1 to FIG. 9.

(1) The courier unlocks the article storage and retrieval apparatus:

when the courier, as a deliverer, needs to put the express in the article storage and retrieval apparatus, a third-party platform such as e-commerce or express and the like will match the article storage and retrieval apparatus according to the order information of the current express and open the authority for the courier to open the article storage and retrieval apparatus, for example, the third-party platform will transmit a verification code, a graphic code and the like for opening the article storage and retrieval apparatus to the courier, or may bind personal identity information (such as fingerprint, face, sound and the like) of the courier with the verification information of the article storage and retrieval apparatus, so that the courier may unlock the first locking assembly between the closed frame 2 and the main frame 1 through identity verification, and the electromagnetic hook 11 is released and separated from the lock groove 21.

(2) The courier opens the article storage and retrieval apparatus and puts the express into the device:

the closed frame 2 and the openable door 3 are unfolded downward as a whole, the second locking assembly is in the locked state at this time, and when the closed frame 2 and the openable door 3 are unfolded vertical to the main frame 1, the closed frame 2 and the openable door 3 are limited by the bottom of the main frame 1. At this time, the closed frame 2 is pulled upward to unlock the second locking assembly, the express is put into the accommodating assembly, and the closed frame 2 is continuously pulled upward until being locked with the main frame 1, thus closing the opening of the accommodating assembly.

(3) The user unlocks the article storage and retrieval apparatus:

The identity verification information of the user may be acquired by the following ways:

1. The user who has performed identity information association with the article storage and retrieval apparatus may directly own the identity verification information of the article storage and retrieval apparatus, for example, preset password for opening the article storage and retrieval apparatus, entered fingerprint, face or sound information.

2. If the express needs to be taken by someone else, the courier may transmit a package taking code to the mobile terminal of the user after putting the express, and the user who has known the package taking code may unlock the article storage and retrieval apparatus by verifying the package taking code.

3. If the express needs to be taken by someone else, the courier may transmit information that the express has been stored to the third-party platform through the mobile terminal after putting the express, the third-party platform may transmit a package taking code to the mobile terminal of the user, and the user who has known the package taking code may unlock the article storage and retrieval apparatus by verifying the package taking code.

After the article storage and retrieval apparatus is unlocked, the electromagnet lock 11 is removed from the lock groove 21.

(4) The user opens the article storage and retrieval apparatus and takes out the express:

The user pushes the closed frame 2 downward to fold the accommodating assembly until the closed frame 2 and the openable door 3 are locked by the second locking assembly, and the express is taken out at this time. The closed frame 2 and the openable door 3 are retracted upward as a whole until the closed frame 2 and the main frame 1 are locked by the first locking assembly, so that the express box is in the closed state.

Similarly, the article storage and retrieval apparatus according to the present disclosure may be applied to the situation that the courier needs to pick up the goods when the user sends or turns and changes goods. different from the above usage scenario, when the user needs to put the express, the user who has performed identity information association with the article storage and retrieval apparatus may directly own the identity verification information of the article storage and retrieval apparatus and may tell the identity verification information to others if asking others to take the express.

Then, after the user stores the express, the user needs to inform the third-party platform that goods need to be sent or returned and hopes the courier to pick up the goods at home, and the third-party platform will arrange a suitable courier to pick up the goods and transmit the identity verification information to the courier who is going to take the goods, so that the arrangement flexibility of the package taking business can be improved; or if the user has a familiar courier, the user may directly transmit the package taking code to the courier.

The article storage and retrieval apparatus according to the present disclosure is introduced above in detail. The principle and embodiments of the present disclosure are elaborated by specific embodiments, and the description of the above embodiments is only intended to help understand the method of the present disclosure and the core concept thereof. It should be noted that those skilled in the art may also make several improvements and modifications without departing from the principles of the present disclosure which should fall within the protection scope of the claims of the present disclosure.

What is claimed is:

1. An article storage and retrieval apparatus, comprising:

a main frame;

an accommodating assembly, having an article storage state and a folded state, the accommodating assembly comprising a closed frame rotatably arranged on the main frame and an openable door, and the closed frame being configured to enclose an article storing space between the accommodating assembly and the main frame in the article storing state;

a first locking assembly, configured to realize locking between the closed frame and the main frame, and allow opening of the article storage and retrieval apparatus after unlocking; and a second locking assembly, configured to realize locking between the closed frame and the openable door, and allow the accommodating assembly to switch from the folded state to the article storage state after unlocking, wherein the second locking assembly comprises an elastic part configured to deform under an action of an external force to realize locking and unlocking of the second locking assembly.

2. The article storage and retrieval apparatus according to claim 1, further comprising a locking protection part arranged on the main frame and configured to restrict the second locking assembly from being unlocked when the article storage and retrieval apparatus is in a closed state.

3. The article storage and retrieval apparatus according to claim 2, wherein the locking protection part comprises a limiting part, the limiting part being arranged in the main frame to prevent the elastic part from changing so as to prevent the second locking assembly from being unlocked when the article storage and retrieval apparatus is in a closed state.

4. The article storage and retrieval apparatus according to claim 3, wherein the locking protection part further comprises a guide part arranged opposite to the limiting part, and the closed frame is embedded between the guide part and the limiting part when the first locking assembly is in a locked state.

5. The article storage and retrieval apparatus according to claim 4, wherein guide portions are arranged at free ends of the limiting part and the guide part, and an opening expanding outwards is formed between the guide portions.

6. The article storage and retrieval apparatus according to claim 1, wherein the second locking assembly is in a locked state during the open or retraction of the closed frame and the openable door relative to the main frame.

7. The article storage and retrieval apparatus according to claim 1, wherein the second locking assembly further comprises:

a pin shaft, slidably arranged in a mounting hole in the closed frame;

a platen, fixed on the closed frame, the elastic part comprising a spring and located between the platen and a first end of the pin shaft; and a pin hole, arranged on the openable door;

a second end of the pin shaft is configured to extend out to enter a pin hole to realize locking in a free state; and the second end of the pin shaft is configured to retract to be removed from the pin hole to realize unlocking under the action of the external force.

8. The article storage and retrieval apparatus according to claim 7, wherein a guide portion is arranged at the second end of the pin shaft or at an open end of the pin hole, and the guide portion is configured to guide the second end of the pin shaft into the pin hole.

9. The article storage and retrieval apparatus according to claim 7, wherein an axis of the pin shaft is vertical to a rotating plane of the closed frame relative to the openable door.

10. The article storage and retrieval apparatus according to claim 1, wherein the first locking assembly is arranged at an open end, relative to the main frame, of the closed frame and is configured to unlock after identity authentication information of a user is verified successfully.

11. The article storage and retrieval apparatus according to claim 1, wherein the first locking assembly comprises: a lock groove and one of a lock hook, a lock rod, and a lock tongue; the lock groove being arranged on one of the main frame and the closed frame, and the one of the lock hook, the lock rod, and the lock tongue being arranged on the other of the main frame and the closed frame and matched with the lock groove; or the first locking assembly comprises: a lock catch arranged on one of the main frame and the closed frame and one of a lock hook and a lock rod arranged on the other of the main frame and the closed frame and matched with the lock catch.

12. The article storage and retrieval apparatus according to claim 1, further comprising a restricted part arranged between the openable door and the closed frame or the main frame, and configured to limit a folding angle of the openable door when the accommodating assembly is in the article storage state.

13. The article storage and retrieval apparatus according to claim 12, further comprising a locking protection part, configured to restrict the second locking assembly from being unlocked when the article storage and retrieval apparatus is in a closed state, the locking protection part, as the restricted part, being configured to restrict the second locking assembly from entering a locked state when the accommodating assembly is in the article storage state.

14. The article storage and retrieval apparatus according to claim 1, wherein the closed frame and the openable door have frame-shaped structures, and when the article storage and retrieval apparatus is in an unfolded state, the closed frame is configured to be folded in an area formed by the openable door and is matched with an inner side wall of the openable door in a circumferential direction.

15. The article storage and retrieval apparatus according to claim 1, wherein the accommodating assembly further comprises:

a flexible covering layer, arranged between the closed frame and the openable door; and a supporting frame, arranged along a circumferential direction of the covering layer, the supporting frame being close to the closed frame and the openable door when the accommodating assembly is in the folded state.

16. The article storage and retrieval apparatus according to claim 1, wherein the openable door comprises:

two groups of connecting rods, first ends of the two groups of connecting rods being rotatably connected to two sides of the main frame respectively;

a supporting plate, a first end of the supporting plate being rotatably connected to the main frame and being located at a bottom of the connecting rods when the openable door is unfolded; and a door plate, a left side, and a right side of an upper end of the door plate being rotatably connected to second ends of the two groups of connecting rods respectively, a lower end of the door plate being rotatably connected to a second end of the supporting plate, there are two parallelogram connecting rod mechanisms formed by each group of connecting rods, the supporting plate, the door plate, and the main frame on two sides of the door plate, and the supporting plate and the door plate are coplanar when the article storage and retrieval apparatus is in a closed state.

17. The article storage and retrieval apparatus according to claim 16, wherein a notch is formed at least at one end of the door plate close to the supporting plate and one end of the supporting plate close to the door plate, and serves as a handle when the openable door is opened or closed.

18. The article storage and retrieval apparatus according to claim 1, wherein the closed frame and the openable door are rotatably connected to one of a bottom end, a left end, and a right end of the main frame.

19. The article storage and retrieval apparatus according to claim 1, wherein the article storage and retrieval apparatus is an express box.

* * * * *